US012799887B2

(12) United States Patent
Agnew

(10) Patent No.: US 12,799,887 B2
(45) Date of Patent: Nov. 17, 2026

(54) EXHAUST CLOSURE DEVICE

(71) Applicant: Christopher Agnew, Newbern, AL (US)

(72) Inventor: Christopher Agnew, Newbern, AL (US)

( * ) Notice: Subject to any disclaimer, the term of this patent is extended or adjusted under 35 U.S.C. 154(b) by 40 days.

(21) Appl. No.: 19/021,535

(22) Filed: Jan. 15, 2025

(65) Prior Publication Data

US 2026/0201825 A1 Jul. 16, 2026

(51) Int. Cl.
*F01N 13/08* (2010.01)

(52) U.S. Cl.
CPC ..... *F01N 13/085* (2013.01); *F01N 13/082* (2013.01); *F01N 2240/36* (2013.01)

(58) Field of Classification Search
CPC ..... B63H 20/245; F01N 1/165; F01N 13/082; F01N 13/085; F01N 2240/36; F01N 2260/14; F02D 9/04; F02D 9/06
See application file for complete search history.

(56) References Cited

U.S. PATENT DOCUMENTS

| | | | | |
|---|---|---|---|---|
| 3,788,072 | A | 1/1974 | Burger | |
| 4,787,869 | A * | 11/1988 | Shiozawa | F01N 13/085 440/89 R |
| 5,355,673 | A | 10/1994 | Sterling | |
| 5,791,953 | A | 8/1998 | Gunderson | |
| 8,317,557 | B2 | 11/2012 | Dudarenke | |
| 8,453,672 | B2 | 6/2013 | Abram | |
| D696,748 | S | 12/2013 | Sisk | |
| 10,982,771 | B2 * | 4/2021 | Botella | F16K 1/221 |
| 11,549,415 | B2 | 1/2023 | Oh | |
| 2003/0134548 | A1 * | 7/2003 | Matsuda | B63H 21/32 440/89 E |
| 2006/0057909 | A1 * | 3/2006 | Yokoya | B63H 21/32 440/38 |

(Continued)

FOREIGN PATENT DOCUMENTS

| | | | | |
|---|---|---|---|---|
| CN | 204200323 U | * | 3/2015 | |
| CN | 107882621 A | * | 4/2018 | F01N 13/085 |

(Continued)

OTHER PUBLICATIONS

Machine translation of CN 107882621 A, accessed Apr. 8, 2026. (Year: 2026).*

(Continued)

*Primary Examiner* — Jonathan R Matthias

(57) ABSTRACT

An exhaust closure device for sealing off a tailpipe to prevent damage to an engine of a vehicle includes a butterfly valve that is coupled the tailpipe. The butterfly valve is actuatable to seal an opening extending into the tailpipe wherein the butterfly valve is designed to inhibit a liquid from travelling inwardly through the tailpipe to the engine. The butterfly valve includes a body that is positionable against a terminal edge of the tailpipe. The terminal edge defines the opening extending into the tailpipe. A disk is pivotably positioned within the body wherein the disk is alternatively positionable between a closed position and an open position. A shaft couples the disk to the body. The shaft is rotatably coupled to the body and statically coupled to the disk wherein rotation of the shaft relative to the body pivots the disk between the closed position and the open position.

10 Claims, 11 Drawing Sheets

(56) References Cited

U.S. PATENT DOCUMENTS

2017/0328291 A1 11/2017 Ito

FOREIGN PATENT DOCUMENTS

| | | | | | |
|---|---|---|---|---|---|
| CN | 107975411 | A | * | 5/2018 | ..... F01N 3/0205 |
| CN | 108425732 | A | * | 8/2018 | ..... F01N 13/085 |
| CN | 109252935 | A | * | 1/2019 | ..... F01N 13/085 |
| CN | 111472870 | A | * | 7/2020 | ..... F01N 3/04 |
| CN | 111997726 | A | * | 11/2020 | ..... G05D 9/12 |
| DE | 202006003593 | U1 | * | 7/2006 | ..... F01N 1/168 |
| WO | WO-2015078431 | A1 | * | 6/2015 | ..... F02D 9/04 |
| WO | WO2016111360 | | | 7/2016 | |

OTHER PUBLICATIONS

Machine translation of CN 111472870 A, accessed Apr. 8, 2026. (Year: 2026).*

* cited by examiner

EXHAUST CLOSURE DEVICE

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to exhaust valves and more particularly pertains to a new exhaust valve for sealing off an exhaust pipe to prevent damage to an engine.

(2) Description of Related Art Including Information Disclosed Under 37 CFR 1.97 and 1.98

The prior art relates to exhaust valves. Exhaust valves are traditionally used to regulate the exhaust pressure for an engine and to remove exhaust gasses from the combustion chamber of the engine. For example, exhaust valves are positioned within tubes and pipes of the exhaust system. Such valves open and close to control the rate at which gasses are expelled from the engine. Exhaust systems on land vehicles (e.g., cars, trucks, motorcycles, or all-terrain vehicles which are designed to travel over land) do not typically include systems for preventing the ingestion of gasses, or liquids, into the exhaust system. When such land vehicles drive through puddles or are otherwise exposed to liquids, there is a risk that liquids will travel inwardly through the exhaust system and flood the engine. Therefore, there is a need in the art for an anti-ingestion device which can be incorporated into the exhaust system of a land vehicle to protect the engine from water damage when such vehicles drive through deep puddles.

Some marine vehicles (e.g., boats, submarines, and other vehicles which are designed to travel through bodies of water) do include anti-ingestion systems to prevent liquids from being drawn back into an engine through the exhaust system. Those anti-ingestion systems were designed because the outlet of the exhaust systems of marine vehicles are regularly submerged in water. However, such devices are typically installed inside the tubes and pipes of the exhaust system, making them difficult or impossible to retrofit onto other vehicles. Therefore, there is a need in the art for an anti-ingestion device which can easily be retrofitted onto an outlet pipe of an exhaust system.

(h) BRIEF SUMMARY OF THE INVENTION

An embodiment of the disclosure meets the needs presented above by generally comprising a vehicle having a tailpipe and an engine. A butterfly valve is coupled the tailpipe. The butterfly valve is actuatable to seal an opening extending into the tailpipe wherein the butterfly valve is configured to inhibit a liquid from travelling inwardly through the tailpipe to the engine. The butterfly valve includes a body that is positionable against a terminal edge of the tailpipe. The terminal edge defines the opening extending into the tailpipe. A disk is pivotably positioned within the body wherein the disk is alternatively positionable between a closed position and an open position. A shaft couples the disk to the body. The shaft is rotatably coupled to the body and statically coupled to the disk wherein rotation of the shaft relative to the body pivots the disk between the closed position and the open position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
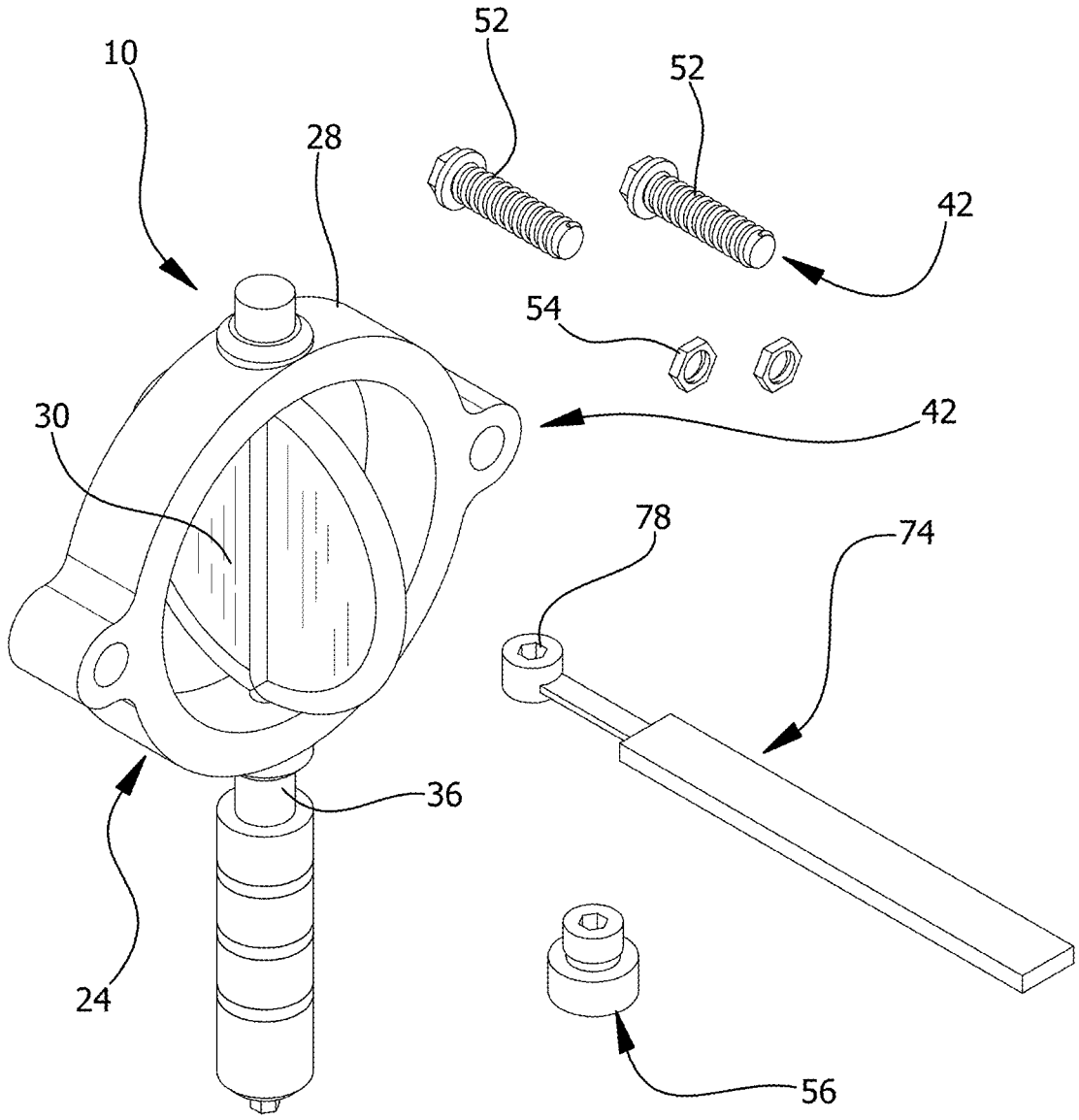
FIG. 1 is a perspective view of an exhaust closure device according to an embodiment of the disclosure.
Figure 2:
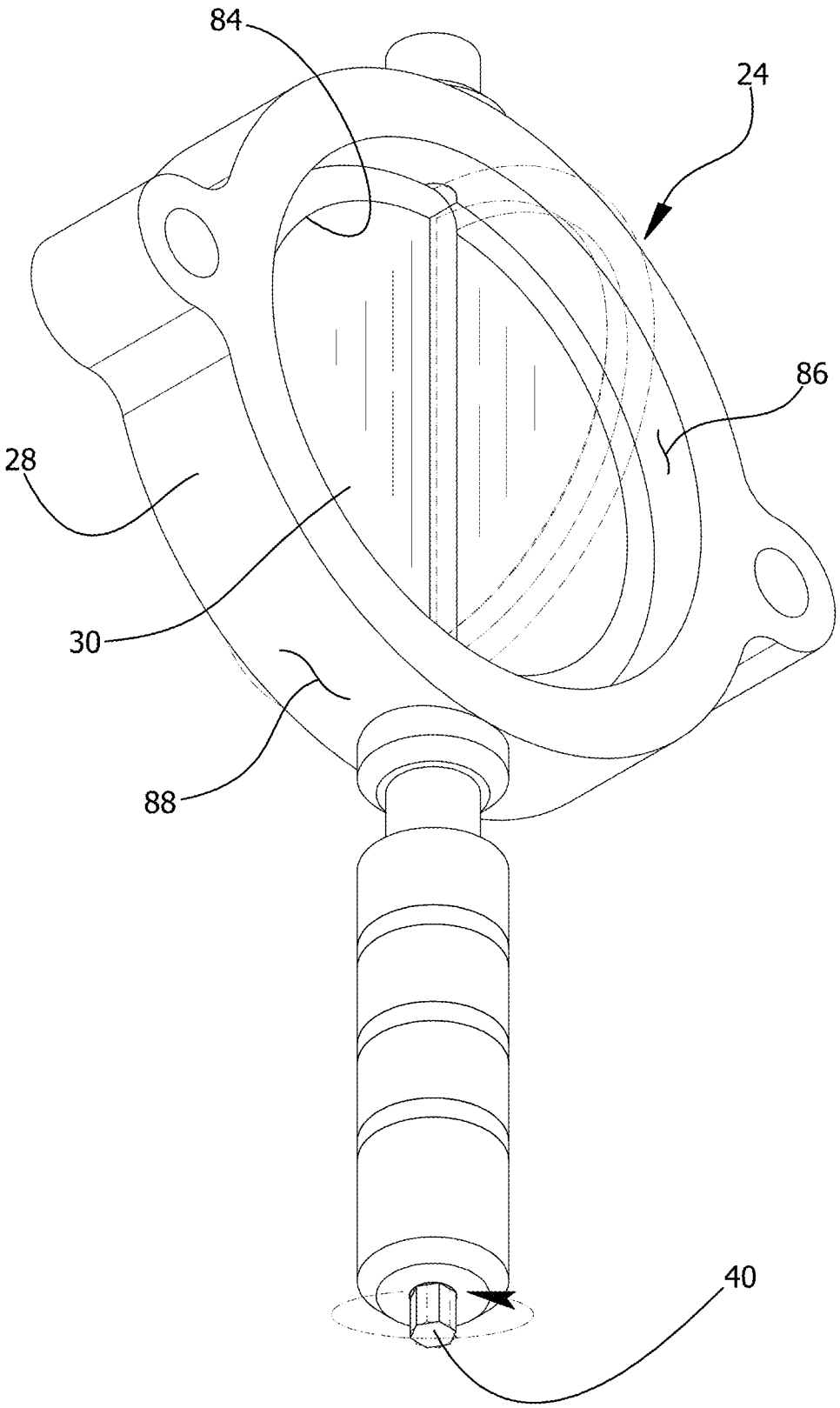
FIG. 2 is a perspective view of an embodiment of the disclosure.
Figure 3:
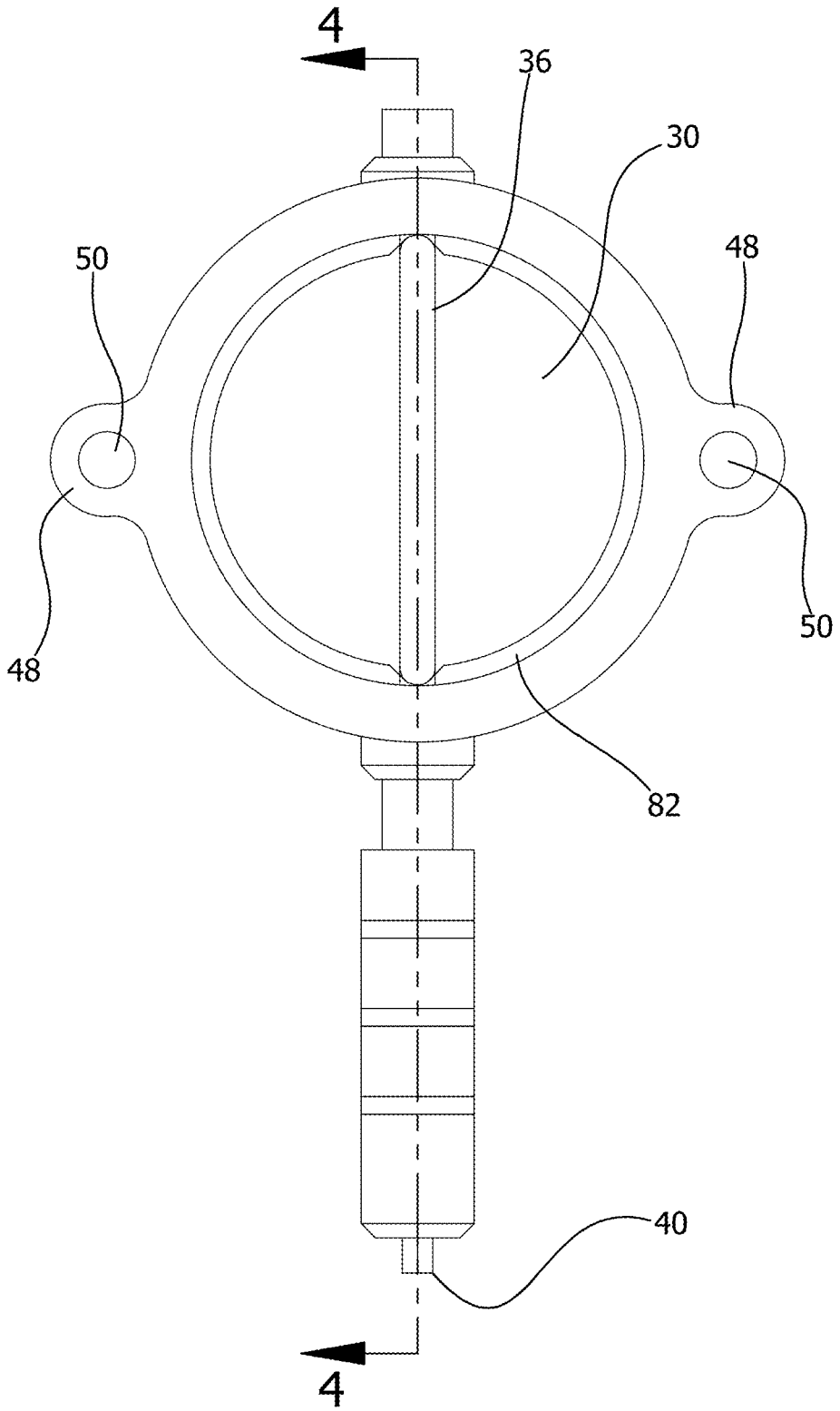
FIG. 3 is a front view of an embodiment of the disclosure.
Figure 4:
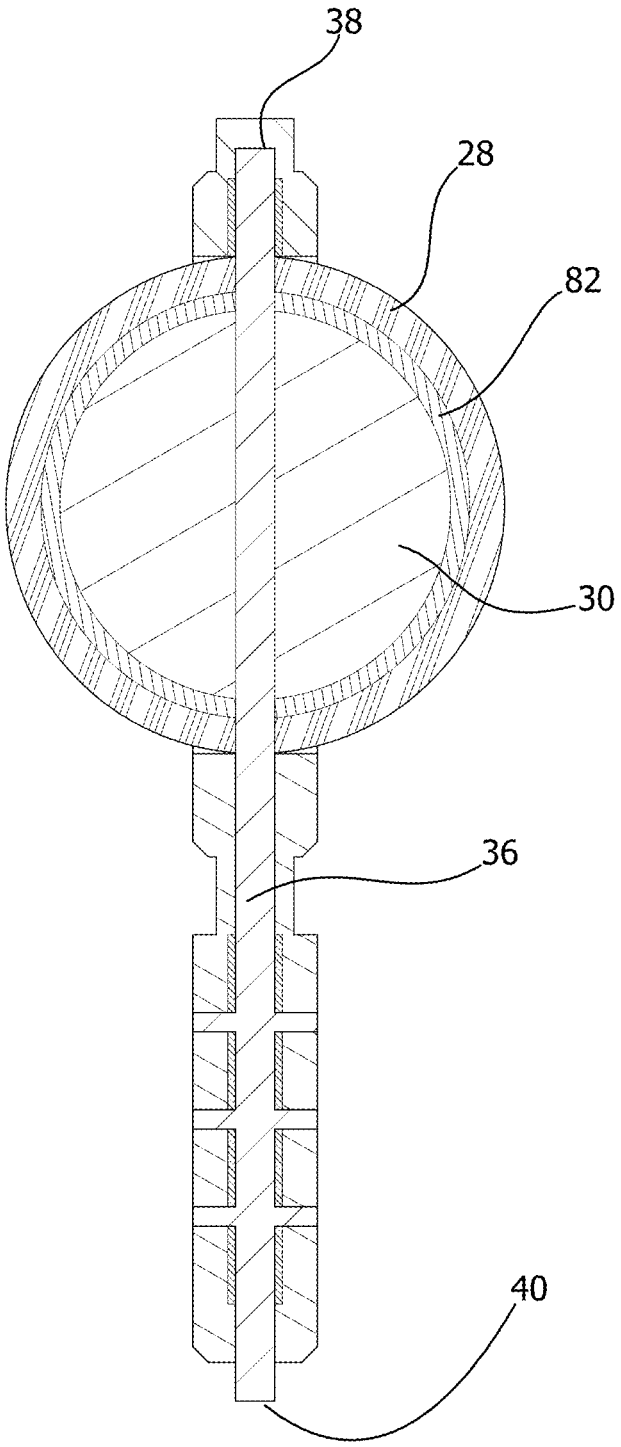
FIG. 4 is a cross-sectional view of an embodiment of the disclosure.
Figure 5:
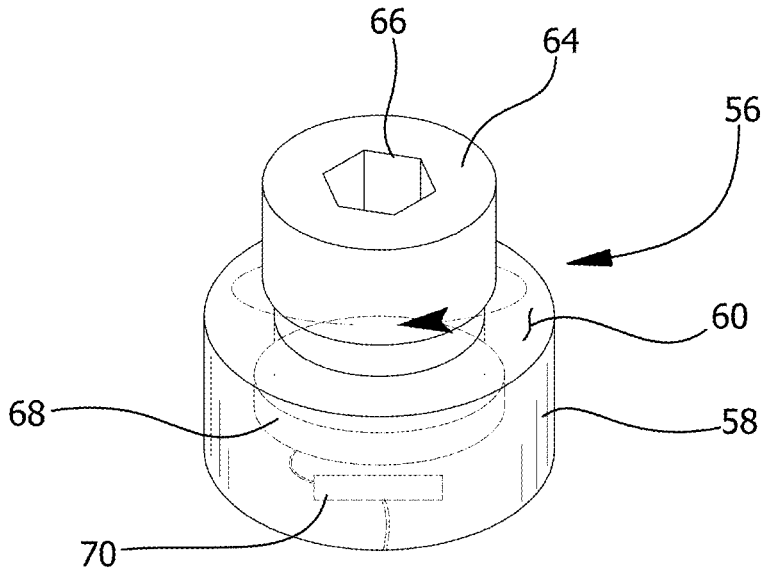
FIG. 5 is a perspective view of an embodiment of the disclosure.
Figure 6:
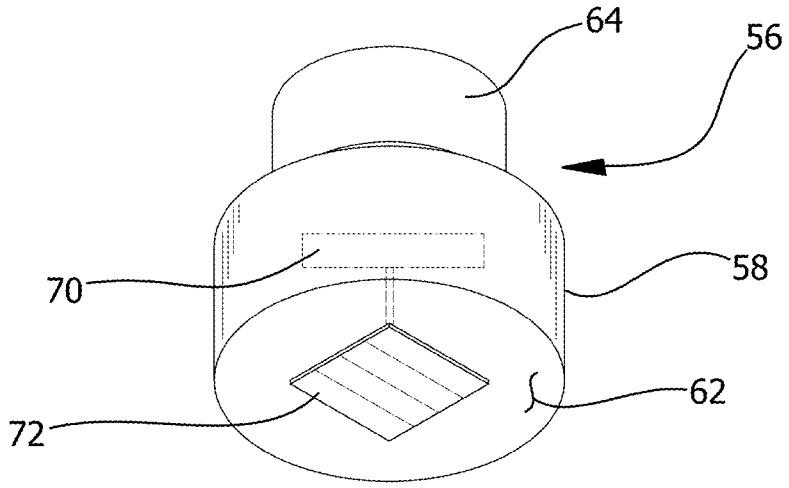
FIG. 6 is a perspective view of an embodiment of the disclosure.
Figure 7:
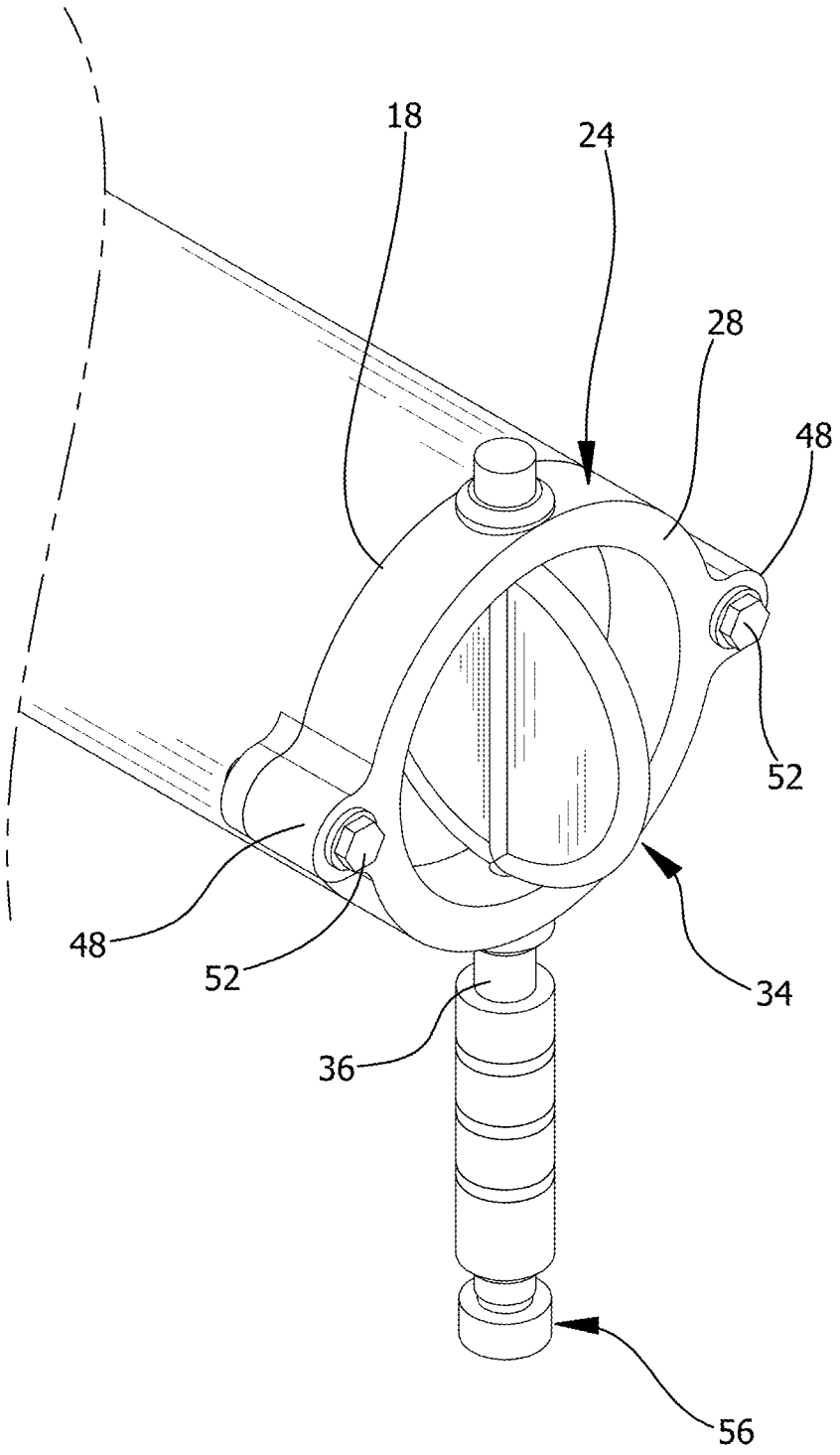
FIG. 7 is a perspective view of an embodiment of the disclosure.

With reference now to the drawings, and in particular to FIGS. 1 through 12 thereof, a new exhaust valve embodying the principles and concepts of an embodiment of the disclosure and generally designated by the reference numeral 10 will be described.

As best illustrated in FIGS. 1 through 12, the exhaust closure device 10 generally comprises a vehicle 12 that has a tailpipe 14 and an engine 16. The tailpipe 14 has a terminal edge 18 that defines an opening 20 that extends into the tailpipe 14 wherein the tailpipe 14 is configured to discharge exhaust 22 from the engine 16 outwardly through the opening 20. In some embodiments, the vehicle 12 may be an all-terrain vehicle or a utility task vehicle which can be used to travel off-road, in either recreational or professional settings. In preferred embodiments, the vehicle 12 is a land-based vehicle (i.e., the vehicle 12 is designed to travel over land,) although amphibious vehicles are also contemplated.

A butterfly valve 24 is coupled to the tailpipe 14. The butterfly valve 24 is actuatable to seal the opening 20 wherein the butterfly valve 24 is configured to inhibit a liquid 26 from travelling inwardly through the tailpipe 14 to the engine 16. More specifically, the butterfly valve 24 is configured to inhibit the liquid 26 from travelling inwardly through the tailpipe 14 to the engine 16 when the tailpipe 14 is submerged in or positioned within the liquid 26. For example, the butterfly valve 24 may seal the opening 20 to inhibit water from travelling through the tailpipe 14 to flood the engine 16 when the vehicle 12 is travelling through puddles, which is a common occurrence for all-terrain vehicles, utility task vehicles, pickup trucks, and other vehicles that travel off-road.

The butterfly valve 24 may be specifically designed to be actuated when the engine 16 is inactive or turned off. For example, the butterfly valve 24 may be open when the engine 16 is running to allow the engine 16 and any existing valves to fully function as designed. When the tailpipe 14 is exposed to the liquid 26, the engine 16 may be deactivated and the butterfly valve 24 may be closed, thereby inhibiting the liquid 26 from entering the tailpipe 14 and travelling to the engine 16. Traditional exhaust control valves are only actuatable when the engine 16 is active, making them ineffective at stopping the liquid 26 from flooding the engine 16 when the engine 16 is turned off.

The butterfly valve 24 generally includes a body 28 that is positionable against the terminal edge 18 of the tailpipe 14. For example, the body 28 may have an outer diameter that is equal to an outer diameter of the terminal edge 18 of the tailpipe 14.

A disk 30 is pivotably positioned within the body 28 wherein the disk 30 is alternatively positionable between a closed position 32 and an open position 34. The disk 30 may be parallel to the terminal edge 18 of the tailpipe 14 when the disk 30 is in the closed position 32. More generally, the disk 30 blocks the opening 20 while the disk 30 is in the closed position 32. The disk 30 may be perpendicular to the terminal edge 18 of the tailpipe 14 when the disk 30 is in the open position 34. More generally, the disk 30 exposes the opening 20 while the disk 30 is in the open position 34.

A shaft 36 couples the disk 30 to the body 28. The shaft 36 is generally rotatably coupled to the body 28 and statically coupled to the disk 30 wherein rotation of the shaft 36 relative to the body 28 pivots the disk 30 between the closed position 32 and the open position 34.

The shaft 36 may be elongated. For example, the shaft 36 may extend vertically along a diameter of the body 28 wherein the shaft 36 has an upper end 38 that is positioned above the body 28 and a lower end 40 that is positioned beneath the body 28. In other words, the upper end 38 of the shaft 36 may be positioned above the tailpipe 14 and the lower end 40 of the shaft 36 may be positioned beneath the tailpipe 14. The lower end 40 may be spaced from the body 28 by a distance exceeding a distance between the upper end 38 and the body 28. Because the lower end 40 is spaced from the body 28, the lower end 40 of the shaft 36 can be used to rotate the shaft 36 without risking physical contact with the tailpipe 14. The tailpipe 14 tends to become extremely hot as the vehicle 12 is being driven because the tailpipe 14 is used to expel hot gasses from the engine 16. Therefore, the distance between the body 28 and the lower end 40 of the shaft 36 may be configured to inhibit the user from physically touching the tailpipe 14 as the user is rotating the shaft 36.

A gasket 82 may be coupled to an outer edge 84 of the disk 30. The gasket 82 may have a width that is complementary to a distance between an interior surface 86 of the body 28 and the outer edge 84 of the disk 30. The gasket 82 inhibits the liquid 26 from leaking through the opening 20, between the interior surface 86 of the body 28 and the outer edge 84 of the disk 30, while the disk 30 is in the closed position 32. Accordingly, the gasket 82 may cover the outer edge 84 of the disk 30. In one more specific example, the gasket 82 may be an O-ring. More generally, the gasket 82 may be made from a waterproof material, to ensure the gasket 82 can form a watertight seal between the disk 30 and the body 28 while the disk 30 is in the closed position 32.

Figure 12:
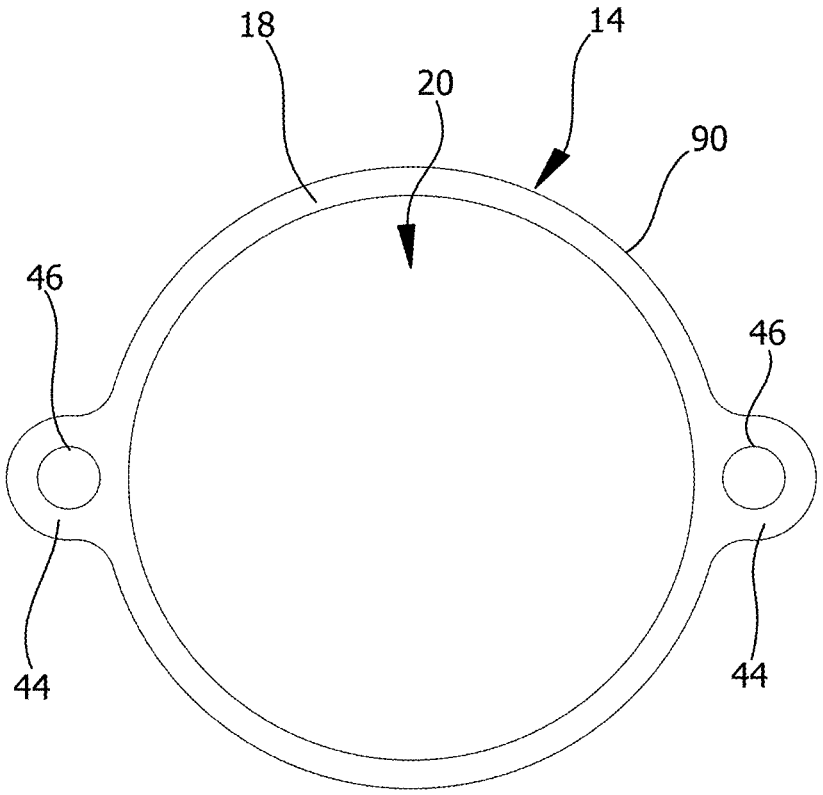
FIG. 12 is a front view of an embodiment of the disclosure.

A coupler 42 may secure the butterfly valve 24 to the tailpipe 14 of the vehicle 12. For example, a pair of fins 44 may be coupled to the tailpipe 14. The pair of fins 44 may extend outwardly in opposing directions from the tailpipe 14. The pair of fins 44 are generally positioned on an outer surface 90 of the tailpipe 14. A pair of bores 46 may extend through the pair of fins 44 wherein each bore of the pair of bores 46 is positioned within a respective fin of the pair of fins 44. FIG. 12 provides an exemplary embodiment.

A pair of projections 48 may be coupled to the body 28 of the butterfly valve 24. The pair of projections 48 may extend outwardly in opposing directions from an exterior surface 90 of the body 28. The pair of projections 48 are alignable with the pair of fins 44 that are coupled to the tailpipe 14. A pair of channels 50 may extend through the pair of projections 48 wherein each channel of the pair of channels 50 is positioned within a respective projection of the pair of projections 48. The pair of channels 50 are aligned with a pair of bores 46 when the pair of projections 48 are aligned with the pair of fins 44.

A pair of fasteners 52 may couple the pair of projections 48 to the pair of fins 44. Each fastener of the pair of fasteners 52 is positionable to extend through a respective channel of pair of channels 50 and a respective bore of the pair of bores 46. For example, the pair of fasteners 52 may be threadably couplable to the pair of fins 44 and the pair of projections 48, such as the bolts shown in FIG. 1.

A pair of retainers 54 may be couplable to the pair of fasteners 52. Each retainer of the pair of retainers 54 secures an associated fastener of the pair of fasteners 52 within the respective channel of the pair of channels 50 and the respective bore of the pair of bores 46. For example, the pair of retainers 54 may be threadably couplable to the pair of fasteners 52, such as the nuts shown in FIG. 1.

A motorized lever 56 may be couplable to the butterfly valve 24. The motorized lever 56 actuates the butterfly valve 24 to seal the opening 20. For example, a hub 58 may have a top surface 60 and a bottom surface 62. The hub 58 may be cylindrical. A neck 64 may be rotatably coupled to the hub 58. The neck 64 may extend upwardly from the top surface 60. The neck 64 may have a diameter that is less than a diameter of the hub 58.

A port 66 may extend into the neck 64 toward the hub 58. The port 66 may have a shape that is complementary to a shape of the lower end 40 of the shaft 36 of the butterfly valve 24. In such embodiments, the lower end 40 of the shaft 36 may be positionable within the port 66 to couple the motorized lever 56 to the shaft 36 via a friction fit. While the lower end 40 of the shaft 36 is secured within the port 66, rotation of the neck 64 rotates the shaft 36 to pivot the disk 30 between the closed position 32 and the open position 34.

A motor 68 may be positioned within the hub 58. The motor 68 is operably coupled to the neck 64 wherein the motor 68 is actuatable to rotate the neck 64 relative to the hub 58. A processor is electrically coupled to the motor 68. A liquid sensor 72 is coupled to the hub 58. The liquid sensor 72 is configured to detect when the liquid 26 contacting the hub 58. For example, the liquid sensor 72 may be positioned on the bottom surface 62 of the hub 58 wherein the liquid sensor 72 is configured to detect when the liquid 26 is contacting the bottom surface 62 of the hub 58. Because the motorized lever 56 is coupled to the lower end 40 of the shaft 36, below the tailpipe 14, the liquid sensor 72 can detect the presence of the liquid 26 before the tailpipe 14 is submerged in the liquid 26.

Figure 9:
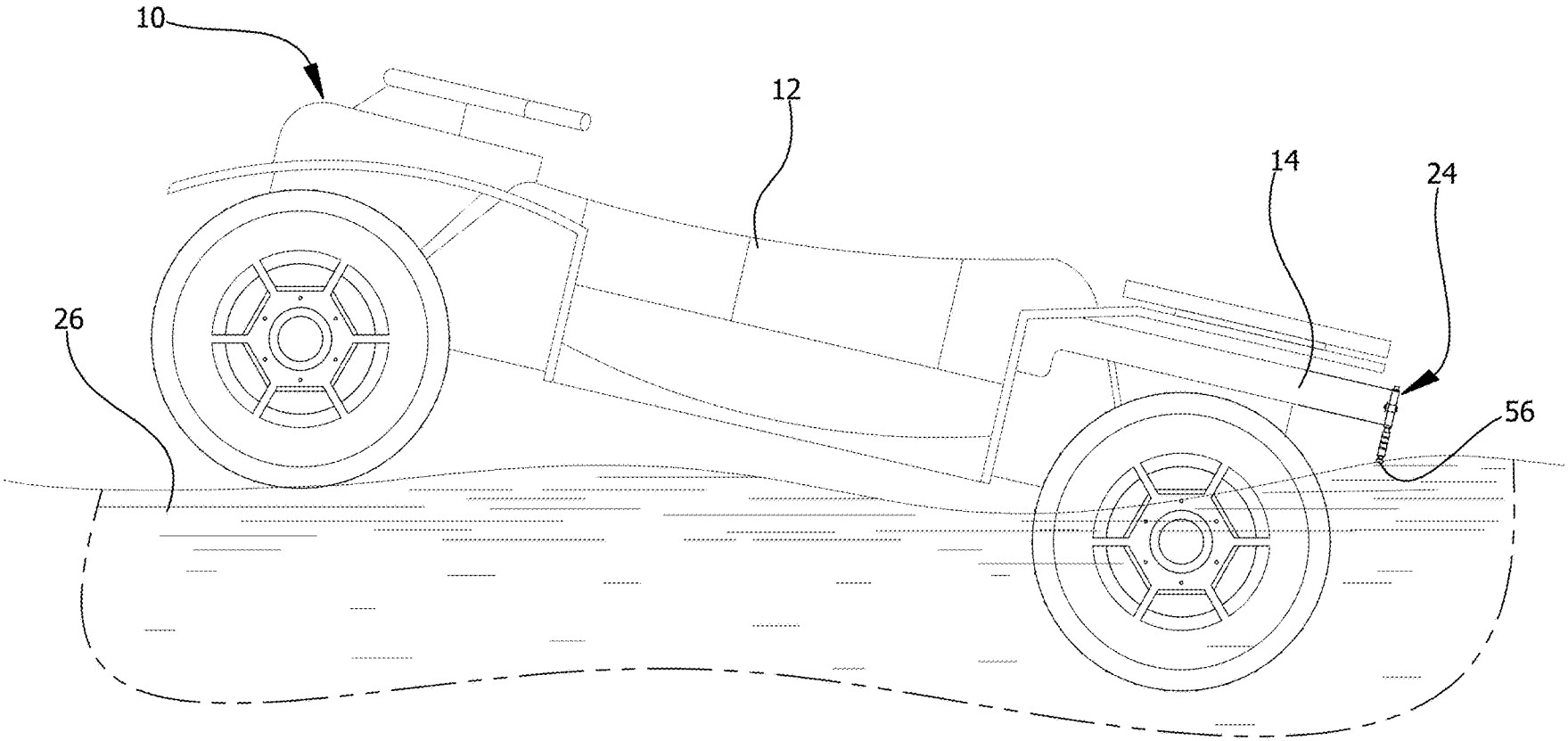
FIG. 9 is an in-use view of an embodiment of the disclosure.
Figure 10:
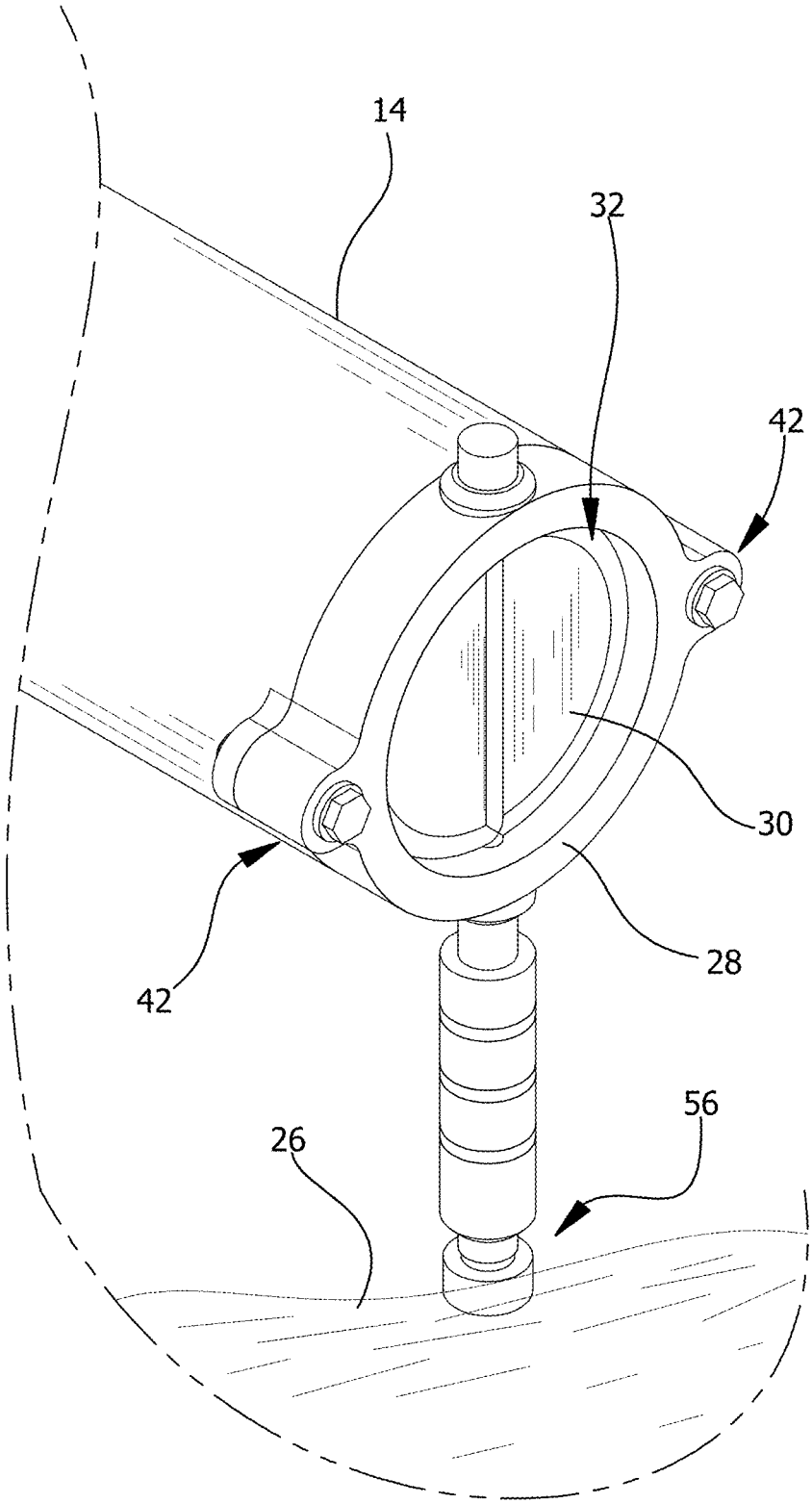
FIG. 10 is an in-use view of an embodiment of the disclosure.
Figure 11:
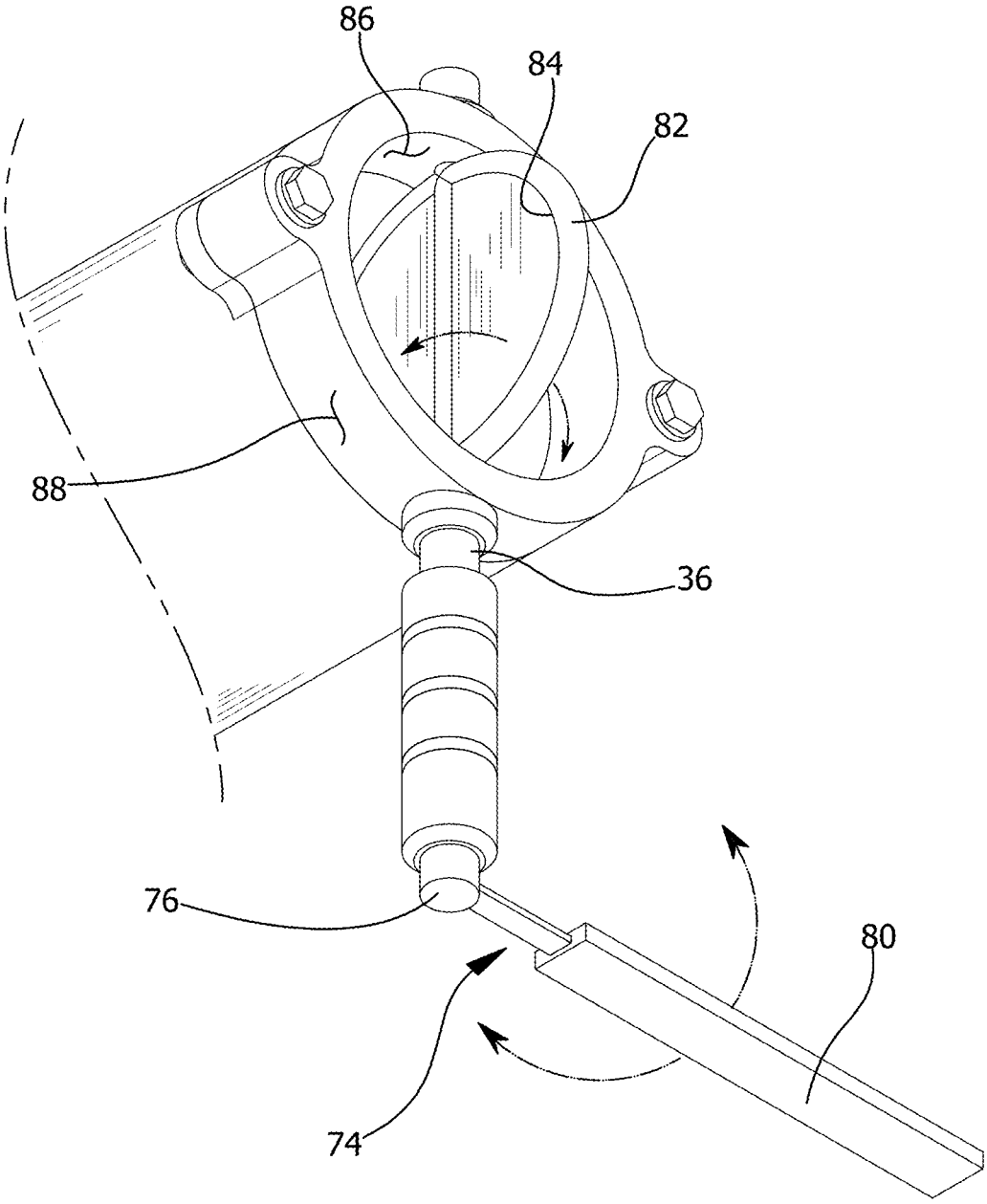
FIG. 11 is an in-use view of an embodiment of the disclosure.

The liquid sensor 72 may be electrically coupled to the processor wherein the processor is configured to actuate the motor 68 when the liquid sensor 72 detects that the liquid 26 is contacting the bottom surface 62 of the hub 58. For example, when the vehicle 12 is driven through a puddle, as shown in FIG. 9, the liquid sensor 72 will be exposed to water and other liquids within the puddle. The liquid sensor 72 can detect that the liquid 26 is contacting the liquid sensor 72, signaling the processor to actuate the motor 68, rotating the neck 64, which rotates the shaft 36 to pivot the disk 30 into the closed position 32. In some embodiments, when the liquid sensor 72 detects that the liquid 26 is not contacting the bottom surface 62 of the hub 58, the processor may actuate the motor 68 to rotate the neck 64 and to pivot the disk 30 into the open position 34.

A manual lever 74 may be couplable to the butterfly valve 24 wherein the manual lever 74 actuates the butterfly valve 24 to seal the opening 20. For example, the manual lever 74 may include a receiver 76. The receiver 76 may be cylindrical. An aperture 78 may extend into the receiver 76. The aperture 78 may have a shape that is complementary to a shape of the lower end 40 of the shaft 36 of the butterfly valve 24 wherein the lower end 40 of the shaft 36 is positionable within the aperture 78 to couple the manual lever 74 to the shaft 36 via a friction fit.

While the lower end 40 of the shaft 36 is secured within the aperture 78, rotation of the receiver 76 rotates the shaft 36 to pivot the disk 30 between the closed position 32 and the open position 34. A handle 80 may be coupled to and extend outwardly from the receiver 76. The handle 80 may be perpendicular to the aperture 78. The handle 80 may be elongated wherein the handle 80 is configured to facilitate a user in rotating the receiver 78 to rotate the shaft 36 of the butterfly valve 24 and pivot the disk 30 between the closed position 32 and the open position 34.

In use, the butterfly valve 24 can be retrofitted onto the tailpipe 14 of the vehicle 12. In other embodiments, the butterfly valve 24 could also be installed on the tailpipe 14 of the vehicle 12 by the manufacturer. The butterfly valve 24 is coupled to the terminal edge 18 of the tailpipe 14 such that the butterfly valve 24 is configured to be readily accessible to the user without requiring access to the interior of the tailpipe 14 or other portions of the exhaust system.

Figure 8:
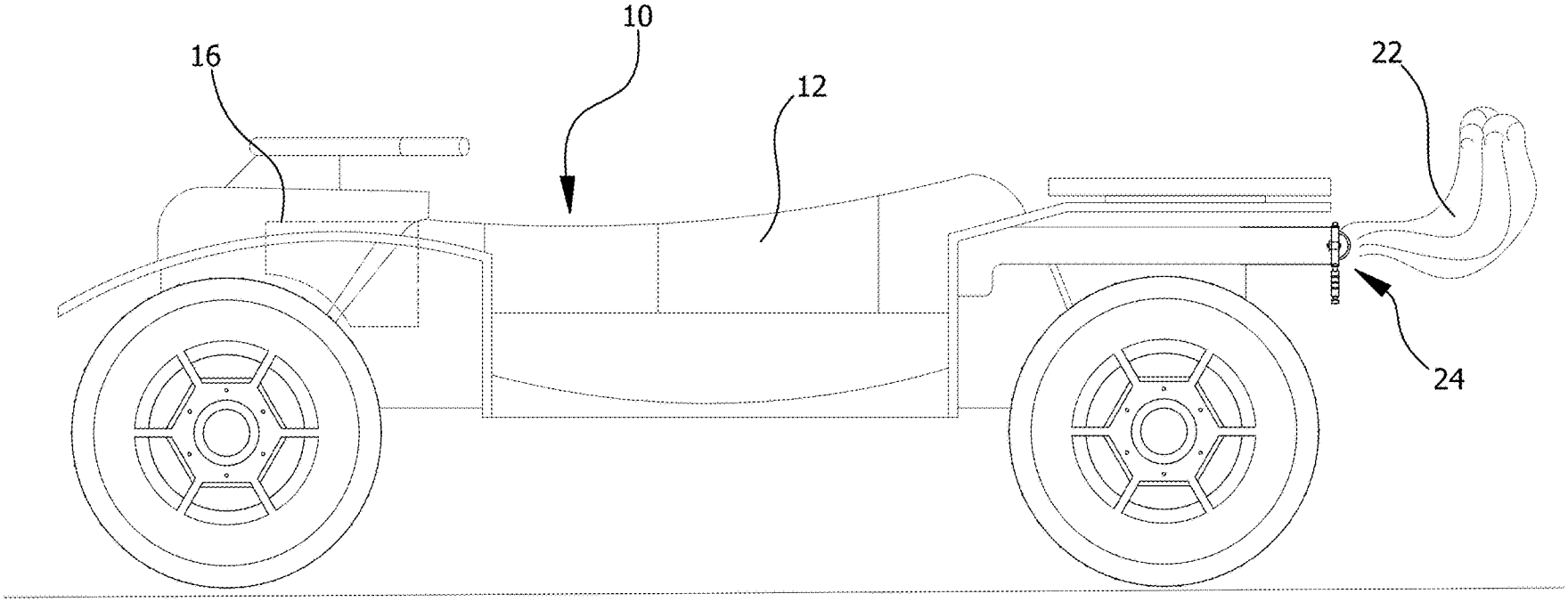
FIG. 8 is an in-use view of an embodiment of the disclosure.

In embodiments including the motorized lever 56, the processor may automatically actuate the motor 68 to pivot the disk 30 into the closed position 32 whenever the liquid sensor 72 detects the presence of the liquid 26. In certain embodiments, the engine 16 may be turned off when the processor actuates the motor 68, for example because the user notices that the vehicle 12 is positioned in a deep enough puddle to expose the tailpipe 14 to the liquid 26, as shown in FIG. 9. Once the liquid sensor 72 is removed from the liquid 26, the processor may automatically actuate the motor 68 to pivot the disk 30 into the open position 34. Accordingly, when the tailpipe 14 is not exposed to the liquid 26, as shown in FIG. 8, the exhaust 22 can be dispelled from the tailpipe 14 as normal.

In embodiments including the manual lever 74, the user may turn the handle 80 to rotate the shaft 36 and move the disk 30 between the closed position 32 and the open position 34. For example, if the vehicle 12 drives through a puddle, as shown in FIG. 9, the user can turn the engine 16 off and position the lower end 40 of the shaft 36 in the aperture 78 extending into the receiver 76. Then, the user can turn the handle 80, rotating the shaft 36 as described above. Once the vehicle 12 is removed from the puddle, the user can reconnect the manual lever 74 to the shaft 36 and pivot the disk 30 into the open position 34.

The motorized lever 56 and the manual lever 74 may each be removably couplable to the shaft 36. In such embodiments, the user may choose which of the motorized lever 56 and the manual lever 74 to use in various situations. For example, if the user is planning to use the vehicle 12 for off-roading on a day when the user knows there will be deep puddles, the user may choose to couple the motorized lever 56 to the shaft 36. When the user is expecting dry conditions, the user may simply bring the manual lever 74 to actuate the butterfly valve 24 as needed. This provides increased versatility and utility, while protecting the engine 16 from becoming flooded and damaged by the liquid 26.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An engine protection system comprising:

a vehicle having a tailpipe and an engine; and a butterfly valve being coupled the tailpipe, the butterfly valve being actuatable to seal an opening extending into the tailpipe wherein the butterfly valve is configured to inhibit a liquid from travelling inwardly through the tailpipe to the engine, the butterfly valve including:

a body being positionable against a terminal edge of the tailpipe, the terminal edge defining the opening extending into the tailpipe;

a disk being pivotably positioned within the body wherein the disk is alternatively positionable between a closed position and an open position;

a shaft coupling the disk to the body, the shaft being rotatably coupled to the body and statically coupled to the disk wherein rotation of the shaft relative to the body pivots the disk between the closed position and the open position; and a motorized lever being couplable to the butterfly valve wherein the motorized lever actuates the butterfly valve to seal the opening, the motorized lever further comprising:

a hub;

a neck being rotatably coupled to the hub;

a port extending into the neck toward the hub, the port having a shape being complementary to a shape of the shaft of the butterfly valve wherein the shaft is positionable within the port to couple the motorized lever to the shaft via a friction fit;

a motor being positioned within the hub, the motor being operably coupled to the neck wherein the motor is actuatable to rotate the neck relative to the hub;

a processor being electrically coupled to the motor; and a liquid sensor being coupled to the hub wherein the liquid sensor is configured to detect when the liquid is contacting a bottom surface of the hub, the liquid sensor being electrically coupled to the processor wherein the processor is configured to actuate the motor when the liquid sensor detects that the liquid is contacting the hub.

2. The engine protection system of claim 1, the butterfly valve further comprising a gasket being coupled to an outer edge of the disk, the gasket having a width being complementary to a distance between an interior surface of the body and the outer edge of the disk wherein the gasket is configured to inhibit the liquid from leaking through the opening while the disk is in the closed position.

3. The engine protection system of claim 2, wherein the disk is parallel to the terminal edge of the tailpipe when the disk is in the closed position wherein the disk blocks the opening while the disk is in the closed position, the disk being perpendicular to the terminal edge of the tailpipe when the disk is in the open position wherein the disk exposes the opening while the disk is in the open position.

4. The engine protection system of claim 1, wherein the shaft extends vertically along a diameter of the body wherein the shaft has an upper end being positioned above the body and a lower end being positioned beneath the body.

5. The engine protection system of claim 1, further comprising a manual lever being couplable to the butterfly valve wherein the manual lever actuates the butterfly valve to seal the opening.

6. The engine protection system of claim 5, the manual lever further comprising:

a receiver;

an aperture extending into the receiver, the aperture having a shape being complementary to a shape of a lower end of the shaft of the butterfly valve wherein the lower end of the shaft is positionable within the aperture to couple the manual lever to the shaft via a friction fit; and a handle being coupled to and extending outwardly from the receiver.

7. The engine protection system of claim 6, wherein the handle is elongated wherein the handle is configured to facilitate a user in pivoting the manual lever to rotate the shaft of the butterfly valve to pivot the disk between the closed position and the open position.

8. An engine protection system comprising:

a vehicle having a tailpipe and an engine, the tailpipe having a terminal edge defining an opening extending into the tailpipe wherein the tailpipe is configured to discharge exhaust from the engine outwardly through the opening;

a butterfly valve being coupled to the tailpipe, the butterfly valve being actuatable when the engine is inactive to seal the opening wherein the butterfly valve is configured to inhibit a liquid from travelling inwardly through the tailpipe to the engine, the butterfly valve including:

a body being positionable against the terminal edge of the tailpipe, the body having an outer diameter being equal to an outer diameter of the terminal edge of the tailpipe;

a disk being pivotably positioned within the body wherein the disk is alternatively positionable between a closed position and an open position, the disk being parallel to the terminal edge of the tailpipe when the disk is in the closed position wherein the disk blocks the opening while the disk is in the closed position, the disk being perpendicular to the terminal edge of the tailpipe when the disk is in the open position wherein the disk exposes the opening while the disk is in the open position;

a shaft coupling the disk to the body, the shaft being rotatably coupled to the body and statically coupled to the disk wherein rotation of the shaft relative to the body pivots the disk between the closed position and the open position, the shaft being elongated, the shaft extending vertically along a diameter of the body wherein the shaft has an upper end being positioned above the body and a lower end being positioned beneath the body, the lower end being spaced from the body by a distance exceeding a distance between the upper end and the body; and a gasket being coupled to an outer edge of the disk, the gasket having a width being complementary to a distance between an interior surface of the body and the outer edge of the disk wherein the gasket is configured to inhibit the liquid from leaking through the opening between the interior surface of the body and the outer edge of the disk while the disk is in the closed position, the gasket covering the outer edge of the disk; and a coupler securing the butterfly valve to the tailpipe of the vehicle, the coupler including:

a pair of fins being coupled to the tailpipe, the pair of fins extending outwardly in opposing directions from the tailpipe;

a pair of bores extending through the pair of fins wherein each bore of the pair of bores is positioned within a respective fin of the pair of fins;

a pair of projections being coupled to the body of the butterfly valve, the pair of projections extending outwardly from opposing directions from the body wherein the pair of projections are alignable with the pair of fins coupled to the tailpipe;

a pair of channels extending through the pair of projections wherein each channel of the pair of channels is positioned within a respective projection of the pair of projections, the pair of channels being aligned with the pair of bores when the pair of projections are aligned with the pair of fins;

a pair of fasteners coupling the pair of projections to the pair of fins, each fastener of the pair of fasteners being positionable to extend through a respective channel of pair of channels and a respective bore of the pair of bores; and a pair of retainers being couplable to the pair of fasteners wherein each retainer of the pair of retainers secures an associated fastener of the pair of fasteners within the respective channel of the pair of channels and the respective bore of the pair of bores; and a motorized lever being couplable to the butterfly valve wherein the motorized lever actuates the butterfly valve to seal the opening, the motorized lever further comprising:

a hub having a top surface and a bottom surface, the hub being cylindrical;

a neck being rotatably coupled to the hub, the neck extending upwardly from the top surface, the neck having a diameter being less than a diameter of the hub;

a port extending into the neck toward the hub, the port having a shape being complementary to a shape of the lower end of the shaft of the butterfly valve wherein the lower end of the shaft is positionable within the port to couple the motorized lever to the shaft via a friction fit;

a motor being positioned within the hub, the motor being operably coupled to the neck wherein the motor is actuatable to rotate the neck relative to the hub;

a processor being electrically coupled to the motor; and a liquid sensor being coupled to the bottom surface of the hub wherein the liquid sensor is configured to detect when the liquid is contacting the bottom surface of the hub, the liquid sensor being electrically coupled to the processor wherein the processor is configured to actuate the motor when the liquid sensor detects that the liquid is contacting the bottom surface of the hub.

9. The engine protection system of claim 8, further comprising a manual lever being couplable to the butterfly valve wherein the manual lever actuates the butterfly valve to seal the opening.

10. The engine protection system of claim 9, the manual lever further comprising:

a receiver, the receiver being cylindrical;

an aperture extending into the receiver, the aperture having a shape being complementary to a shape of the lower end of the shaft of the butterfly valve wherein the lower end of the shaft is positionable within the aperture to couple the manual lever to the shaft via a friction fit; and a handle being coupled to and extending outwardly from the receiver, the handle being perpendicular to the aperture, the handle being elongated wherein the handle is configured to facilitate a user in pivoting the receiver to rotate the shaft of the butterfly valve and pivot the disk between the closed position and the open position.

* * * * *